United States Patent [19]

Wilk, deceased

[11] Patent Number: 4,570,719

[45] Date of Patent: Feb. 18, 1986

[54] DRY PIPE VALVE ACCELERATOR

[75] Inventor: David A. Wilk, deceased, late of West Warwick, R.I., by Lois Wilk, executrix

[73] Assignee: Grinnell Fire Protection Systems Company, Inc., Cranston, R.I.

[21] Appl. No.: 616,484

[22] Filed: Jun. 1, 1984

[51] Int. Cl.[3] ..... A62C 37/06

[52] U.S. Cl. ..... 169/20; 169/17; 137/467

[58] Field of Search ..... 169/20–22, 169/17; 137/467, 492, 492.5

[56] References Cited

U.S. PATENT DOCUMENTS 4,458,716 7/1984 Danré .....137/492.5

FOREIGN PATENT DOCUMENTS 2054209 2/1981 United Kingdom ..... 137/492

*Primary Examiner*—Andres Kashnikow
*Assistant Examiner*—Scott D. Malpede
*Attorney, Agent, or Firm*—Salter & Michaelson

[57] ABSTRACT

A dry pipe valve accelerator is operative for quickening the operation of a dry pipe valve in a dry sprinkler system in order to hasten the delivery of water throughout the system in response to the operation of one or more sprinkler heads of the system. The accelerator is automatically actuated in response to a slight but significant rate of decay in system gas pressure, such as is caused by the operation of a sprinkler head of the system; and when the accelerator is actuated, an exhaust valve element thereof is moved from a closed position to an open position wherein the accelerator provides an interconnection between the pressurized portion of the system and the intermediate chamber of the dry pipe valve to effect the opening of the latter. Concurrent with the movement of the exhaust valve element to the open position thereof, an antiflood valve of the accelerator is moved to a closed position wherein water delivered to the system and any debris entrained in the water are prevented from reaching the operative components of the accelerator. Further, once the accelerator has been actuated, it is automatically releasably retained in an actuated position so that the sprinkler system can be drained and serviced while the operative components of the accelerator are fully protected from exposure to debris and/or water. After the debris and/or water have been cleared from the system, the accelerator can easily be manually reset by manipulating an external reset member to again render the accelerator responsive to decays in system pressure.

19 Claims, 4 Drawing Figures

DRY PIPE VALVE ACCELERATOR

BACKGROUND AND SUMMARY OF THE INVENTION

The instant invention relates to automatic dry pipe sprinkler systems of the type used for fire protection, and more particularly to an accelerator for quickening the opening of a differential type of dry pipe (water control) valve in response to the operation of one or more sprinkler heads.

Basically, there are two predominant types of automatic fire protection sprinkler systems; a wet pipe system wherein the piping leading from its water control valve to the sprinkler heads is normally filled with water, and a dry pipe system wherein the piping leading from its water control valve to the sprinkler heads is pressurized with a gas until the water control (dry pipe) valve closing off the source of water from the system has been opened to introduce water into the piping leading to the sprinkler heads thereof. Wet pipe sprinkler systems offer the advantage of water being immediately discharged from an operated sprinkler. On the other hand, wet pipe sprinkler systems cannot be readily used in applications where there is a possibility that the system piping interconnecting the sprinkler head will be exposed to freezing temperatures. Accordingly, dry pipe sprinkler systems are normally used in applications where freezing temperatures can occur. Dry pipe sprinkler systems, however, have the drawback that because the piping thereof is normally filed with pressurized gas and not water, water is not immediately discharged from an operated sprinkler.

In dry pipe sprinkler systems, when a sprinkler head is operated, a portion of the gas flows out through the opened sprinkler head, causing a decrease in the pressure of the gas in the piping connected thereto. When the pressure of the gas in the piping drops to a certain level, the dry pipe valve automatically opens so that water can be introduced into the piping. However, because gas is a compressible medium, it takes a relatively substantial amount of time for the pressure of the gas in the piping to decay to a level which is sufficient to open the dry pipe valve connected thereto. Obviously, when a fire occurs, it is critical that water be delivered to an operated sprinkler as quickly as possible. Accordingly, the National Fire Protection Association Standard NFPA-13 requires that dry pipe sprinkler systems be constructed such that when the sprinkler head furthest from the dry pipe valve is operated, water will be delivered thereto within sixty seconds of the time of operation. For this reason, many dry pipe sprinkler systems require an accelerator which is utilized for sensing a slight but significant rate of decay in the dry pipe system gas pressure and for quickening the opening of the dry pipe valve connected thereto, in response to the pressure decay.

A differential type of a dry pipe valve is by definition constructed with two chambers; a main chamber which is exposed to system pressure and an intermediate chamber which is normally exposed to atmospheric pressure. Further, a differential type of dry pipe valve is designed such that when a fluid under a pressure of essentially the same value as the gas in the system is admitted to the intermediate chamber thereof, its channel between the source of water supply and the system will be opened. Accordingly, an accelerator is interconnected by piping between its inlet and the pressurized portion of the system and between its outlet and the intermediate chamber of the dry pipe valve such that when the accelerator is actuated, gas under pressure is admitted from the system to the intermediate chamber of the dry pipe valve to effect the opening of the latter.

Accelerators representing the closest prior art to the instant invention, of which the applicant is aware, are disclosed in the U.S. patents to Rowley U.S. Pat. No. 1,913,245; Herkimer U.S. Pat. No. 2,822,052; Zimmerman U.S. Pat. No. 3,685,586; and Shea U.S. Pat. No. 3,785,440. While these references do teach a variety of accelerator constructions, they do not teach an accelerator having the specific structural features and specific advantages of the accelerator of the instant invention, and hence they are believed to be of nothing more than general interest, as will hereinafter be made apparent.

Once water has been introduced into a dry pipe sprinkler system by opening of its dry pipe valve, the water can freely pass through the piping leading to the sprinkler heads thereof as well as the accelerator. While water and small quantities of debris which may be entrained in the water will not normally damage the exhaust valve element portion of the accelerator which is operative for opening the passageway between the system and the intermediate chamber of the dry pipe valve, it is important that the debris and/or water does not reach the components which effect the actuation of the accelerator. In this regard, most dry pipe valve accelerators are constructed with a first or differential chamber and a second or pilot chamber which communicate through a restriction which retards the equalization of the pressure of the gas in the two chambers and, by so doing, causes the actuation of the accelerator. It is essential for the reliable operation of an accelerator of this type that the restriction thereof be protected from debris and/or water which can clog it and substantially lower the rate of pressure equalization between the two chambers below the desired preset rate, and by so doing, cause the accelerator to unnecessarily actuate in response to inconsequential reductions in system pressure which can result from minor gas leaks or temperature drops. It is also desirable that any debris entrained within the water introduced to the system be kept from entering the second said chamber which normally encloses the actuation mechanism of the accelerator so that the freedom of movement of the mechanism will not be affected. The principal time of concern is when water is flowing into the system under pressure. However, a further desirable feature of dry pipe valve accelerators is that no debris and/or water be permitted to enter the second chamber or come in contact with the restriction after the flow of water into the system has been shut off and while all debris and water is being drained from the system as well as the piping interconnecting the accelerator with the system. None of the heretofore available dry pipe valve accelerators have reliably provided all of these features. Specifically, while some of the known accelerators have included means for protecting the internal components thereof from the pressurized water which is distributed throughout the system after opening of the dry pipe valve, none of the known accelerators have included means for reliably protecting the internal components which effect the actuation thereof from a relatively low pressure water which is present when the system is shut off and water is being drained from the system.

The instant invention provides a novel dry pipe valve accelerator which effectively overcomes this and other disadvantages of the heretofore known accelerators. In contrast to the previously known accelerators, the internal operating components of the accelerator of the instant invention are completely protected against debris and/or water under all high and low pressure conditions. Further, the accelerator of the instant invention includes a novel latching assembly which assures that once the accelerator has been actuated, the internal components thereof are maintained fully protected until the accelerator is manually reset and again rendered responsive to a decay in system pressure. Accordingly, once the accelerator has been actuated, the first and second internal chambers thereof and all of the internal components thereof, including the restriction element of the accelerator (all of which will hereinafter be more fully described), are fully protected against debris and/or water which might otherwise undesirably affect the operation of the accelerator. After the dry pipe sprinkler system has been shut down and drained such that it is apparent that all of the debris and/or water has been removed from the system, the accelerator of the instant invention can easily be reset by manipulation of a knob external to the accelerator so that the internal components of the accelerator are again rendered fully operative. Hence, for these reasons, as well as a number of other reasons which will hereinafter be set forth, it will become apparent that the accelerators of the instant invention represents a significant advancement in the art.

The accelerator of the instant invention comprises a housing having a first or differential chamber, a second or pilot chamber, and a valve body adjacent the second chamber, the body having a passage therethrough with an inlet end connectable by piping to the pressurized portion of a dry pipe sprinkler system and an outlet end connectable by piping to the intermediate chamber of a differential-type dry pipe valve, the housing also having a restriction joining the first and second chambers for providing retarded pressure equalization therebetween, an aperture between the second chamber and the inlet end of the passage, and a relief port between the second chamber and the exterior of the housing (i.e., atmosphere). An antiflood valve is provided in the second chamber and is alternatively positionable in open or closed positions thereof wherein said aperture is opened or closed, respectively, the antiflood valve being normally biased to the open position thereof. A relief valve is also provided in the second chamber and is alternatively positionable in open or closed positions thereof wherein said relief port is opened or closed, respectively, the relief valve being normally biased to the closed position thereof. A lever interconnecting the antiflood and relief valves maintains them in the opposite respective positions thereof. An actuator assembly that is positioned at the interface between the first and second chambers is movably responsive to a pressure decrease from the first chamber to the second chamber for rotating said lever and thereby moving the antiflood valve to the closed position thereof and, therefore, the relief valve to the open position thereof. Also provided in the accelerator is an exhaust valve element mounted in the housing which is alternatively positionable in open (tripped) or closed (set) positions thereof wherein the passage is opened or closed, respectively. The exhaust valve element is normally positioned in the closed position thereof when the antiflood valve is in the open position thereof, and it is constructed so that when the gas pressure in the second chamber is substantially equal to the gas pressure in the inlet end of the passage, the exhaust valve element is maintained in the closed position thereof by a combination of the force exerted by a spring acting on the lever and by the pressure in the second chamber. The exhaust valve element is, however, responsive to a condition wherein the pressure in the second chamber is substantially less than the pressure in the inlet end of the passage for movement of the exhaust valve element to the open position thereof whereby the passage between the inlet and outlet ends of the accelerator is made open. Accordingly, when the actuator assembly moves the antiflood valve towards the closed position thereof and the relief valve to the open position thereof, whereby the pressure in the second chamber is decreased to essentially atmospheric pressure, the pressure differential created between the inlet end of the passage and the second chamber causes the exhaust valve element to be moved to the open (tripped) position thereof. The preferred embodiment of the accelerator further comprises a latching member which is engageable with said lever, by the action of the exhaust valve element moving to the open position, to releasably retain it (by externally manipulative means) in a position wherein the antiflood valve is maintained in a closed position in the aperture, the relief valve is maintained in an open position from the relief port and the exhaust valve element is maintained in an open (tripped) position in the passage.

In the operation of the accelerator, the antiflood valve is normally maintained in the open position so that the pressure in the inlet end of the passage is essentially equal to the pressure in the second chamber whereby the exhaust valve element is maintained in a closed position in the passage. When a sprinkler head in the system is operated so that the pressure in the system commences to decay, the pressure in the second chamber of the accelerator decreases, because it is open to the system through the aperture. Since there is a restriction joining the first and second chambers of the accelerator, the pressure in the first chamber does not decrease as rapidly as the pressure in the second chamber and, therefore, a pressure differential is created between the first and second chambers. When this pressure differential reaches a predetermined level, the actuator assembly of the accelerator acts on the lever to move the antiflood valve towards its closed position in the aperture and to move the relief valve to an open position from the relief port whereby the second chamber is opened to the atmosphere. As a result, a substantial decrease in the pressure in the second chamber relative to the pressure in the inlet end of the passage is created, and the exhaust valve element can no longer be retained in the closed position thereof by the pressure in the second chamber. Consequently, the pressure in the inlet end of the passage moves the exhaust valve element to the open position thereof. Accordingly, the accelerator admits gas under pressure from the system to the intermediate chamber of the differential type of dry pipe valve to effect the opening of the latter. After the dry pipe valve has been opened, the passage in the accelerator is open to the sprinkler system (at its inlet end) so that water can enter the passage. It will be noted, however, that while water can enter the passage, it cannot reach either of the first or second chambers of the accelerator so that all of the operative components of the accelerator are also protected from debris, which could be carried by the water. Further, since the accelerator includes means for releasably retaining it in a position wherein the antiflood valve is in a closed position in the aperture, water cannot enter the second chamber regardless of the system pressure, and therefore the operative components of the accelerator, including the restriction, are protected from exposure to debris and/or water, even when and after the system is shut down.

Accordingly, it is a primary object of the instant invention to provide an effective and reliable differential-type dry pipe valve accelerator for dry pipe sprinkler systems.

Another object of the instant invention is to provide a differential-type dry pipe valve accelerator wherein the operative components thereof are fully protected from debris and/or water by the closing of an internal antiflood valve, even when and after the sprinkler system connected to the accelerator are shut down.

A still further object of the instant invention is to provide an accelerator which must be reset by manually manipulating an external reset element before it can be reused.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
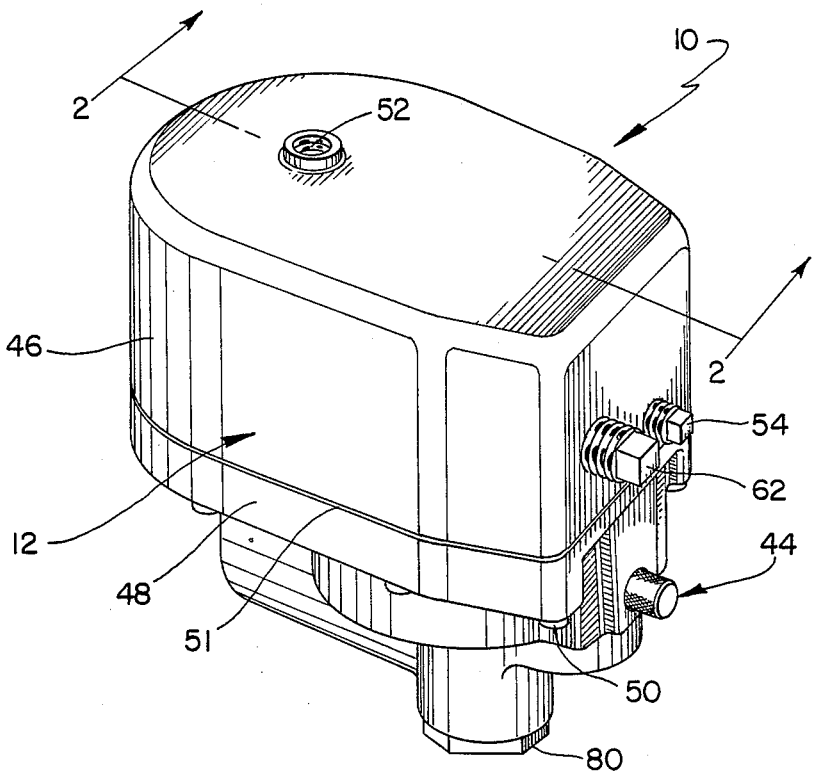
FIG. 1 is a perspective view of the accelerator of the instant invention.

Referring now to the drawings, the accelerator of the instant invention is illustrated in FIGS. 1 through 4 and generally indicated at 10. The accelerator 10 is constructed for use in combination with a differential-type dry pipe valve of a dry pipe sprinkler system, wherein the sprinkler system normally contains a pressurized gas, and it is operative for sensing the rate of decay in system gas pressure such as is produced by the operation of a sprinkler head of the system and for accelerating the opening of the dry pipe valve in response thereto.

The accelerator 10 generally comprises a housing generally indicated at 12 having first and second chambers 14 and 16, respectively, and a valve body generally indicated at 18 which is adjacent the second chamber 16, the valve body having a passage 19 therethrough with an inlet end 20 connectable to the pressurized portion of the dry pipe sprinkler system and an outlet end 22 connectable to the intermediate chamber of a differential-type dry pipe valve. Provided in the housing 12 is an interconnection passage or opening generally indicated at 24 which provides communication between the first and second chambers 14 and 16, respectively, and a restriction assembly generally indicated at 26 is received in the opening 24 for providing retarded pressure equalization between the first and second chambers 14 and 16, respectively. An aperture 28 is provided in the housing 12 extending between the second chamber 16 and the inlet end of the passage 19, and a relief port 30 is provided extending between the second chamber 16 and the exterior of the housing 12. An antiflood valve 32 is provided in the aperture 28 and is operable between open and closed positions thereof wherein the aperture 28 is open and closed, respectively, and a spring 33 resiliently biases the antiflood valve 32 to the open position thereof. A relief valve 34 is provided in the second chamber 16 and is operable between open and closed positions thereof wherein the relief valve 30 is opened and closed, respectively, and a linkage or lever assembly generally indicated at 36 interconnects the antiflood valve 32 to the relief valve 34 to maintain them in the opposite respective positions thereof. A plunger or actuator assembly generally indicated by 38 is provided at an interface between the first and second chambers 14 and 16, respectively, and is operable in response to a predetermined relative pressure decrease between the first chamber 14 and second chamber 16 for moving the antiflood valve 32 from the open position thereof to the closed position thereof and for simultaneously moving the relief valve 34 from the closed position thereof to the open position thereof. Also provided in the accelerator 10 is an exhaust valve element generally indicated by 40 which travels in an opening 42 which extends between the second chamber 16 and the passage 19 and which is receivable in the passage 19 for the closing thereof. In this connection, the exhaust valve element 40 is operative so that it is maintained in the closed (set) position thereof by a combination of the spring 33 acting against lever assembly 36 and the pressure in the second chamber 16 when the antiflood valve 32 in the open position thereof but so that it is movably responsive to a predetermined pressure differential between the inlet end 20 of the passage 19 and the second chamber 16, such as is produced when the antiflood valve 32 closes off aperture 28 and the relief valve 34 is removed from the relief port 30, for movement of the exhaust valve element 40 to the open (tripped) position thereof wherein the passage 19 is unobstructed so that fluid communication is provided between the inlet and outlet ends 20 and 22 thereof, respectively. A latch or retainer clip assembly 44 is also provided in the accelerator 10 and is constructed for engagement with the lever assembly 36 for detachably retaining it in the actuated position illustrated in FIG. 3 wherein the antiflood valve 32 is in the closed position thereof and the relief valve 34 is in the open position thereof, and for preventing the return of the exhaust valve element 40 to the closed (set) position thereof.

Figure 4:
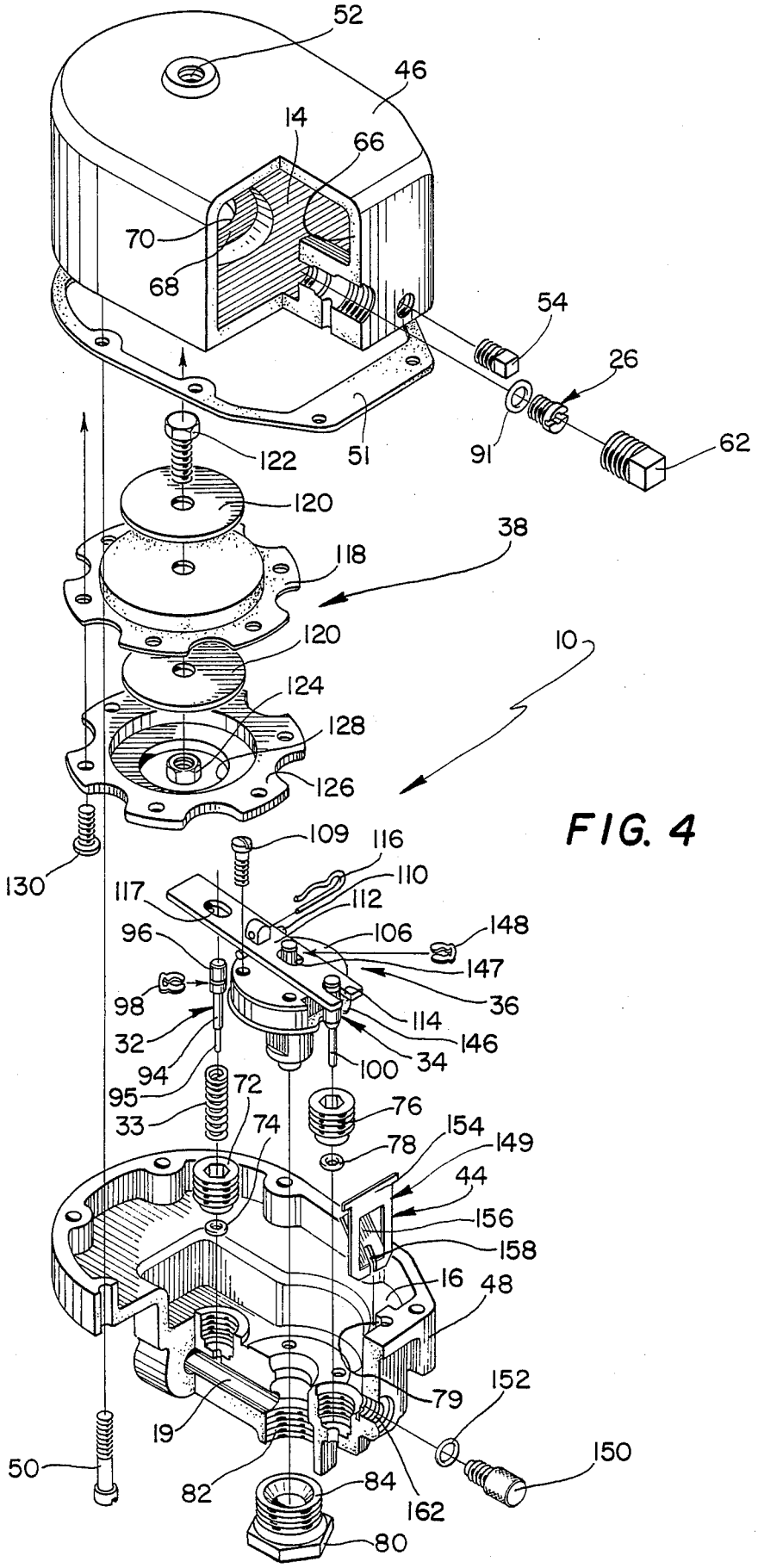
FIG. 4 is an exploded perspective view of the accelerator.

The housing 12 is preferably constructed of a suitable metal, such as aluminum, in a two-piece construction which includes a cover or upper housing portion 46 and a base or lower housing portion 48 which are maintained in assembled relation with screws 50, and a gasket 51 is interposed between the housing portions 46 and 48. A threaded opening 52 is provided in the upper portion 46 for connection of a pressure gauge to the first chamber 14 of accelerator 10, and a vent plug 54 is threadedly received in a vent opening in the upper housing portion 46. The opening 24 which extends between the first and second chambers 14 and 16, respectively, threadedly receives restriction assembly 26, and is in communication with a slightly enlarge outer portion 58, and a reduced passage 60 extends downwardly from the outer portion 58 to the second chamber 16. An access plug 62 is threadedly received in an access opening 64 which provides access to the restriction assembly 26 for the replacement thereof. The lower extremity of the upper portion 46 is defined by a lower wall 66 which forms a mating surface for the assembly of the upper portion 46 with the lower portion 48. Included in the lower wall 66 is a raised portion 68 having a central opening 70 therethrough. The lower portion 48 of the housing 12 defines the second chamber 16 and the valve body 18. An apertured plug 72 having an enlarged upper recess 73 is threadedly received in the lower portion 48 and defines the aperture 28, and an O-ring 74 is provided at the lower end of the plug 72 in communication with the aperture 28. Similarly, an apertured plug 76 having an enlarged upper recess 77 is threadedly received in the lower portion 48 and defines the aperture 30, and an O-ring 78 is provided adjacent the lower end of the plug 76 in communication with the aperture 30. A vertical track 79 which is illustrated in FIG. 4 is integrally formed in the lower portion 48 for receiving portions of the latch or retainer clip assembly 44, as will hereinafter be more fully described. The valve body 18 defines the passage 19 and is formed so that the inlet end 20 and the outlet end 22 are adapted for threaded interconnection with piping for connecting the accelerator 10 to the pressurized portion of a dry pipe sprinkler system and the intermediate chamber of a differential-type dry pipe valve, respectively. In this regard, the outlet end 22 of the passage 19 is defined by an apertured plug 80 which is threadedly received in an opening 82 in the body portion 18, the plug 80 having a conical inner surface 84 which defines a seat for the exhaust valve element 40 for sealingly receiving the exhaust valve element 40 in the passage 19.

The restriction assembly 26 is threadedly received in the opening 24, and an O-ring 91 is provided adjacent the head of the restriction assembly 26 for providing a seal between the restriction assembly 26 and the opening 24. The restriction assembly 26 comprises a plug portion 88 having an axial opening 90 therethrough and a sintered metal restriction portion 92 which provides a reduced rate of gas flow through the axial opening 90. Accordingly, the restriction assembly 26 provides retarded rate of gas pressure equalization between the first and second chambers 14 and 16 so that when the pressure in the first chamber is greater than the pressure in the second chamber, a significant period of time is required for the equalization of the two pressures through the restriction assembly 26.

The antiflood valve 32 provides an anti-flood device in the accelerator 10, whereby water is prevented from reaching the operative components of the accelerator 10 when it is in an actuated position. In this connection, the antiflood valve 32 includes a reduced lower pin portion 94 which is sealingly receivable in the opening 28 through the O-ring 74, and a needle-like end 95. The spring 33 is located coaxially around the antiflood valve 32 so that the lower end of the spring 33 is received in the recess 73. The antiflood valve 32 has an enlarged head portion 96 and a retaining clip 98 is received on the head portion 96 to retain the spring 33 on the antiflood valve 32. Accordingly, the spring 33, as hereinabove set forth, normally biases the antiflood valve 32 to an open position thereof wherein the aperture 28 is open, and hence gas can pass therethrough.

The relief valve 34 is similar in construction to the antiflood valve 32 and has a lower pin portion 100 which is sealingly receivable in the relief port 30 through the O-ring 78. The relief valve 34 includes an enlarged head portion 102 having an annular groove 104 adjacent the upper end thereof.

Figure 2:
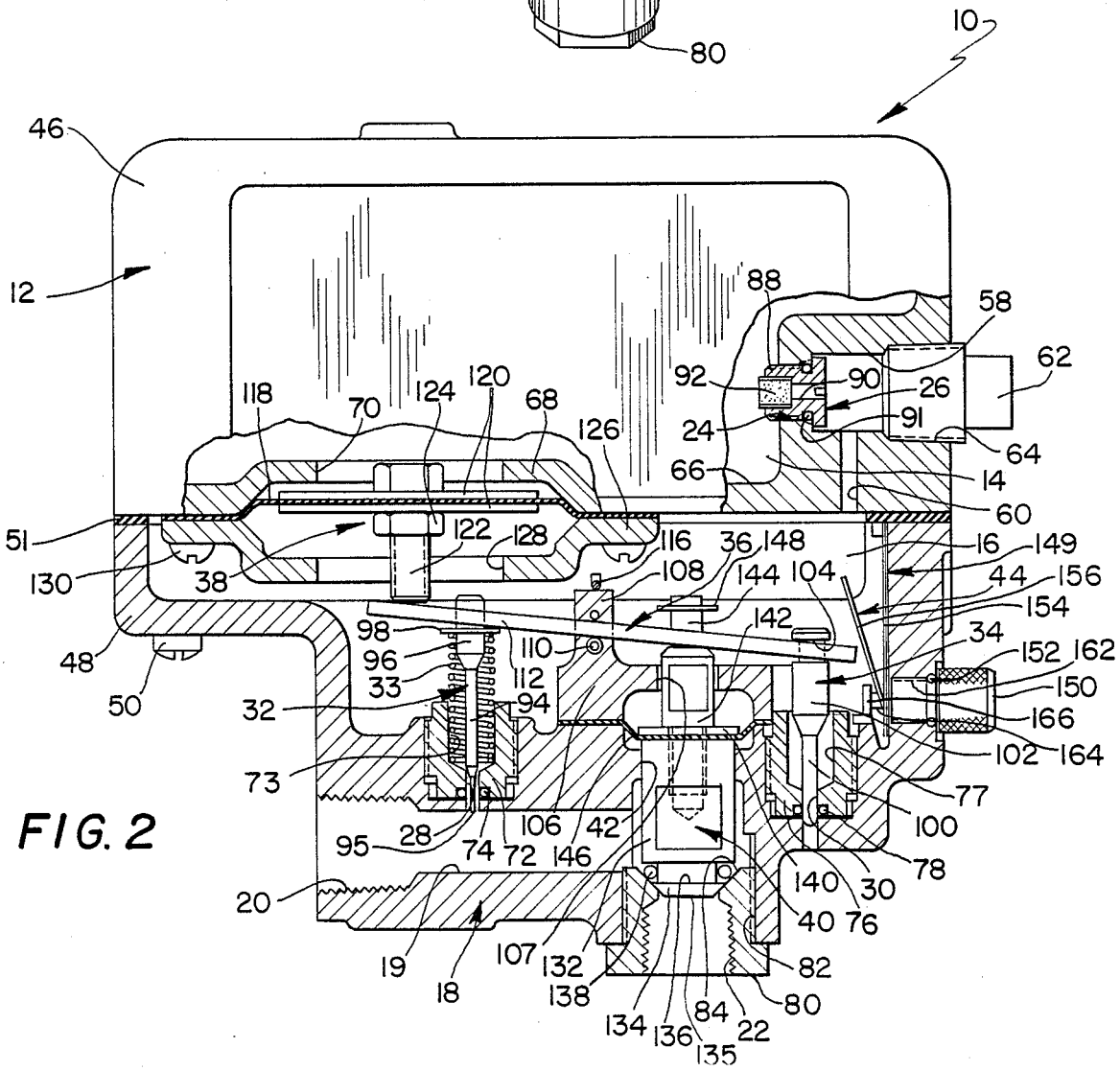
FIG. 2 is an enlarged sectional view taken along line 2—2 in FIG. 1 and showing the accelerator in its unactuated or set position.

The lever assembly 36 interconnects the antiflood and relief valves 32 and 34, respectively, and is operative for maintaining them in the opposite respective positions thereof. The lever assembly 36 comprises a pivot base 106, having a central opening 107, which is secured to the housing 12 adjacent the lower end of the second chamber 16 with screws 109. Extending integrally upwardly from the pivot base 106 is a fulcrum post 108 having a fulcrum pin 110 extending transversely therethrough. Also comprising part of the lever assembly 36 is a lever 112 having a slot 114 adjacent one end thereof as illustrated in FIG. 4. The lever 112 is received on the fulcrum post 108 so that it rests on the fulcrum pin 110, and a clip 116 retains the art 112 on the post 108. When the arm 112 is received in the second chamber 16 in this manner, the enlarged head 96 of the antiflood valve 32 extends through an opening 117 in the arm 112 so that the arm 112 rests on the retaining ring 98. The enlarged head 102 of the relief valve 34 is secured to the end of the arm 112 opposite from the opening 117 with the slot 114 received in the annular groove 104 of the head portion 102. Accordingly, it is seen that the lever assembly 36 interconnects the antiflood and relief valves 32 and 34, respectively, to maintain them in the opposite respective positions thereof. More specifically, since the antiflood valve 32 is normally biased to an open position by the spring 33, the lever 112 is normally maintained in a position wherein it maintains the relief valve 34 so that the lower pin portion 100 thereof is received within the O-ring 78 to seal the relief port 30, as illustrated in FIG. 2.

The actuator assembly 38 is operative for moving the antiflood valve 32 from the open position thereof to the closed position thereof so that the relief valve 34 is simultaneously moved from the closed position thereof to the open position thereof. In this connection, the actuator assembly 38 comprises a diaphragm 118 which is interposed between a pair of circular plates 120. The actuator assembly 38 further comprises an actuator member or bolt 122 which extends downwardly through the plates 120 and the diaphragm 118 and is secured thereto with a nut 124. An upper diaphragm plate 126 having a central opening 128 therethrough is secured to the lower surface of the bottom wall 66 adjacent the raised portion 68 with screws 130, and the diaphragm 118 is sealingly received between the plate 126 and the bottom wall 66. Accordingly, the actuator member 122 is movable in response to a pressure differential between the first and second chambers 14 and 16, and the raised portion 68 and the plate 126 limit the extend of upward and downward movement, respectively, of the plates 120 and the actuator member 122 in order to prevent damage to the diaphragm 118. Further, it is seen that when the pressure in the first chamber 14 is significantly greater than the pressure in the second chamber 16, the diaphragm 118 permits the actuator member 122 to be moved downward against lever 112 so that the antiflood valve 32 is moved to a closed position wherein the pin portion 94 thereof is received through the O-ring 74 in the aperture 28 and so that the relief valve 34 is moved to an open position wherein the lower pin portion 100 thereof is withdrawn from the port 30, as illustrated in FIG. 3.

The exhaust valve element 40 is operative between open (set) and closed (tripped) positions whereby the passage 19 is open and closed, respectively. The exhaust valve element 40 comprises an enlarged lower plug portion 132 having a beveled lower end portion 134 which terminates in an end surface 135 and has an annular groove 136 therein containing an O-ring 138. The exhaust valve element 40 further comprises a diaphragm plate portion 140, a reduced intermediate portion 142, and a further reduced upper terminal or stem portion 144 which extends integrally from the intermediate portion 142. A diaphragm 146 is sealingly secured over the opening 42 and is sealingly interposed between the enlarged lower plug portion 132 and the plate portion 140, and the intermediate 142 is threadedly received in an axial opening in the lower plug portion 132 as illustrated. The exhaust valve element 40 is mounted in the housing 12 so that the enlarged lower plug portion 132 travels in the opening 42 and so that the intermediate portion 142 travels in the opening 107 for movement of the exhaust valve element 40 between the open and closed positions thereof wherein the passage 19 is opened and closed, respectively. The stem portion 144 extends through an opening 147 at an intermediate point in the linkage arm 112, and a clip 148 retains the stem portion in the opening 147. It will be noted that when the exhaust valve element 40 is in the closed position thereof, the O-ring 138 provides a seal with the surface 84 to close the passage 19. The diaphragm 146, the plate portion 140, the intermediate portion 142 and the terminal portion 144 are constructed so that the gas in the second chamber 16 exerts forces on each of these components in the exhaust valve element 40 which tend to maintain it in the closed (set) position. Further, since the outlet end 22 is connected to the intermediate chamber of a differential-type dry pipe valve, the pressure in the outlet end 22 is normally equal to atmospheric pressure when the exhaust valve element 40 is closed. Therefore, the effect of atmospheric pressure acting on the surface 135 is inconsequential in comparison to the effects of the pressure in the second chamber 16 acting on diaphragm 146, plate portion 140, intermediate portion 142 and the end of the stem portion 144. As a result, it is seen that the pressure in passage 19 must be made sufficiently greater than the pressure in the second chamber 16 in order for the exhaust valve element 40 to be moved to the open position thereof. This is accomplished when the antiflood valve 32 is moved to the closed position thereof and the relief valve 39 is moved to the open position thereof, thereby reducing the pressure in second chamber 16 to atmospheric pressure while maintaining passage 19 at a greater pressure which functions to move the exhaust valve element 40 to the fully-open (tripped) position thereof as illustrated in FIG. 3

Figure 3:
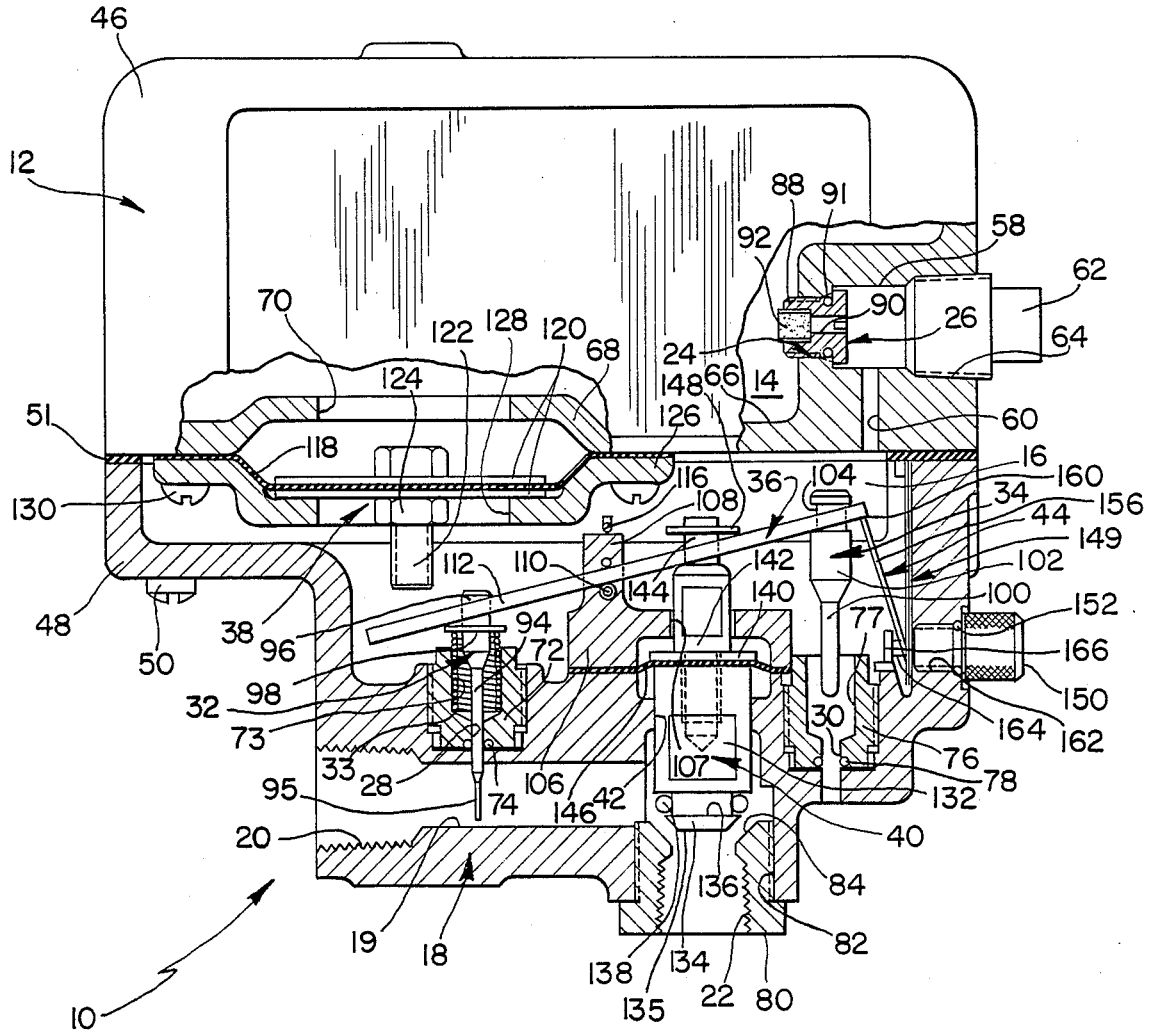
FIG. 3 is a similar view with the accelerator in the actuated or tripped position.

The latch or retainer clip assembly 44 is operative for releasably retaining the accelerator 10 in the position illustrated in FIG. 3 wherein the antiflood valve 32 is held in the closed position thereof, the relief valve 34 is held in the open position thereof, and the exhaust valve element 40 is held in the open position thereof. The latch or retainer clip assembly 44 comprises a resilient retainer clip generally indicated at 149 which is most clearly illustrated in FIG. 4, and a reset screw 150 on which an O-ring 152 is received. The retainer clip 149 comprises a base portion 154 and a resilient tongue 156 which is integrally struck in the clip 149, and a notch 158 is provided in the lower end of the clip 149. The retainer clip 149 is received in the tracks 79 in the lower housing portion 48 and thereby retained in a substantially vertical disposition, and the tongue 156 extends upwardly and inwardly in the second chamber 16 from the base portion 154. As will be seen from FIG. 3, when the lever 112 is moved by the full opening of exhaust valve element 40 to a position wherein the relief valve 34 is in an open position, i.e., it is fully withdrawn from the relief port 30, the tongue 156 engages the lower surface of the lever 112 as at 160 so that the lever 112 is prevented from returning to a position wherein the relief valve 34 is in the closed position thereof and the antiflood valve 32 is in the open position thereof. Further, when the lever 112 is retained in this position, the clip 148 on the stem portion 144 of the exhaust valve element 40 engages the lever 112 so that the exhaust valve element 40 is also retained in the open position thereof. The reset knob 150 is threadedly received in an opening 162 in the lower housing portion 48 and has an annular groove 164 adjacent the inner terminal end thereof which defines an inner terminal head 166 on the inner end of the knob 150. The reset knob 150 is positioned in the second chamber 16 so that the lower notch 158 in the tongue 156 is received on the annular groove 164. Accordingly, when the knob 150 is unscrewed, the head 166 engages the tongue 156 to draw it toward the base portion 154 whereby the tongue 156 is removed from its position of engagement with the lever 112 so that the spring 33 resiliently returns the antiflood valve 32 to the open position thereof and the relief valve 34 to the closed position thereof, as illustrated in FIG. 2.

In operation of the accelerator 10, the inlet end 20 of the passage 19 is interconnected to the pressurized portion of a dry pipe sprinkler system and therefore to the main chamber of a differential-type dry pipe valve of the system, and the outlet end 22 of the passage 19 is interconnected to the intermediate chamber of the dry pipe valve, and the accelerator 10 is positioned in the unactuated position thereof illustrated in FIG. 2. When a sprinkler head in the system is actuated so that the pressure in the main chamber of the dry pipe valve begins to decay, the accelerator senses the decay and introduces pressurized gas into the intermediate chamber of the differential-type dry pipe valve to effect the actuation thereof. In this connection, when the accelerator 10 is in its unactuated or operative position illustrated in FIG. 2, the antiflood valve 32 is in the open position thereof, the relief valve 34 is in the closed position thereof, and the exhaust valve element 40 is also in the closed position thereof. Accordingly, the pressure in the second chamber 16 is essentially equal to the pressure in the inlet end 20 of the passage 19. Under equilibrium conditions, the pressure in the first chamber 14 is essentially equal to the pressure in the second chamber 16, since the two chamber 14 and 16 are interconnected by the restriction assembly 26. However, when a sprinkler head in the system is operated so that the pressure in the inlet end 20 of the passage 19 and therefore in the second chamber 16 begins to decay, a pressure differential develops between the first and second chambers 14 and 16, respectively. This is because the only interconnection between the first and second chambers 14 and 16 is through the restriction assembly 26 which provides a retarded pressure equalization therebetween so that the pressure in the first chamber 14 decays at a slower rate than the pressure in the second chamber 16. As the pressure differential between the chambers 14 and 16 increases, the actuator assembly 38 gradually moves downwardly against lever 112 and thereby moves the antiflood valve 32 downwardly into closing relation in the aperture 28 and causing the relief valve 34 to be simultaneously withdrawn from the relief port 30. Accordingly, the interconnection between the second chamber 16 and the inlet end 20 of the passage is closed, and the second chamber 16 is opened to the atmosphere through the relief port 30. When this occurs, the pressure in the second chamber 16 is immediately reduced to essentially the level of atmospheric pressure so that a differential is realized between the inlet end 20 and the second chamber 16. It is this differential which causes the exhaust valve element 40 to be moved to an open (tripped) position so that the passage 19 is opened to interconnect the system with the intermediate chamber of the differential-type dry pipe valve connected thereto. Specifically, when the pressure in the inlet end 20 is significantly greater than the pressure in the second chamber 16, the forces on the lower surface of the diaphragm 146 are sufficient to overcome the forces on the upper surface of the diaphragm 146, the upper surface of the plate 140, and the axial components of the forces applied by the gas in the second chamber 16 on the other surfaces of the exhaust valve element 40, and therefore the exhaust valve element 40 is moved upwardly in the opening 42 to open the passage 19. When this occurs, the exhaust valve element 40 engages the lever 112 to move the antiflood valve 32 further into the aperture 28 and to further withdraw the relief valve 34 from the relief port 30, and the lever 112 is moved to its fully actuated position as illustrated in FIG. 3. In this connection, when the lever 112 is moved to its actuated position, the tongue 156 is depressed towards the base portion 154 of the retainer clip 148 until the end of the lever 112 has moved past the tongue 156 whereupon the tongue 156 is resiliently moved outwardly to a position wherein it engages with the undersurface of the lever 112 as at 160 to retain the accelerator 10 in the actuated position thereof.

Once the accelerator 10 has been moved to the actuated position thereof, gas can pass freely through the passage 19 to actuate the dry pipe valve connected thereto. Further, once the accelerator 10 has been actuated, the operative components thereof, including the restriction assembly 26, are fully protected from exposure to debris and/or water which may enter the passage 19. In this connection, the antiflood valve 32 is sealingly received in the aperture 28 so that water is prevented from entering the second chamber 16 or the first chamber 14, and the latch or retainer clip assembly 44 retains the antiflood valve 32 in the closed position thereof regardless of the pressure in the passage 19. Therefore, inadvertent water leakage into the chamber 16 is prevented; and after the accelerator 10 has been actuated, the lines leading thereto and therefrom can be purged to be sure that they are free from water before the accelerator 10 is reset. After the lines have been fully cleared of water, the reset knob 150 is unscrewed to disengage the tongue 156 from the lever 112 whereupon the spring 33 resiliently returns the antiflood valve 32 to the open position thereof, the relief valve 34 to the closed position thereof, and the valve element assembly 40 to the closed (set) position thereof, whereby the accelerator 10 is once again rendered fully operative for sensing decay in system pressure as caused by the operation of a sprinkler head.

It is seen, therefore, that the instant invention provides an effective accelerator for use in dry pipe sprinkler systems. The operative components of the accelerator are full protected from water entering through the dry pipe valve, and the latch or retainer clip assembly 44 prevents the exhaust valve element 40 from returning to a closed position before the accelerator 10 has been manually reset. The latch or retainer clip assembly 44 also retains the antiflood valve 32 in the closed position thereof and the relief valve 34 in the open position thereof. The accelerator 10 is operative with differential pressure to effect movement of the exhaust valve element 40, and the restriction assembly 26 is easily accessible for replacement if needed. For these reasons, as well as the other reasons hereinabove set forth, the accelerator 10 represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An accelerator for use in combination with a differential-type dry pipe valve in a dry pipe sprinkler system and the like wherein the system normally contains a pressurized gas, said accelerator comprising a valve body having a passage therethrough, said passage having inlet and outlet ends which are interconnectable to the pressurized portion of said sprinkler system and to the intermediate chamber of said dry pipe valve, respectively, an exhaust valve element in said valve body alternatively positionable in open or closed positions thereof for opening or closing said passage, respectively, said exhaust valve element being normally biased to the closed position thereof, a housing adjacent said valve body, the interior of said housing being interconnected with said passage through an antiflood aperture in said accelerator and being interconnected with the exterior of said accelerator through a relief port in said accelerator, an antiflood valve in said accelerator alternatively positionable in open or closed positions thereof for opening or closing said antiflood aperture, respectively, a relief valve in said accelerator alternatively positionable in open or closed positions thereof for opening or closing said relief port, respectively, and means communicating with said passage inlet end for moving said antiflood valve to the closed position thereof, said relief valve to the open position thereof and said exhaust valve element to the open position thereof when the rate of pressure decay in said inlet end exceeds a predetermined level.

2. In the accelerator of claim 1, said housing having first and second chambers therein, said chambers being interconnected through a restricted opening which provides retarded pressure equalization therebetween, said pressure decay responsive means being operative in response to a predetermined pressure differential between said first and second chambers.

3. In the accelerator of claim 2, said antiflood aperture communicating with said housing second chamber, said relief port extending from said second chamber to the exterior of said housing.

4. In the accelerator of claim 3, said exhaust valve element being operative in response to the pressure differential produced between said passage inlet end and said second chamber when said antiflood valve is moved to the closed position thereof and said relief valve is moved to the open position thereof for movement of said exhaust valve element to the open position thereof.

5. In the accelerator of claim 3, said housing having an opening therein between said first and second chambers, said decay responsive means further comprising a diaphragm sealingly received in said second opening and a plunger mounted on said diaphragm, said plunger interconnecting with said antiflood valve and said relief valve and upon movement of said diaphragm a predetermned amount toward said second chamber, said plunger moving said antiflood valve to the closed position thereof and said relief valve to the open position thereof.

6. In the accelerator of claim 3, said exhaust valve element being configured and dimensioned so that when the pressure in said second chamber is substantially equal to the pressure in the inlet end of said passage, and the pressure in the outlet end of said passage is substantially less than the pressure in the inlet end thereof, the resultant forces on said exhaust valve element produced by the pressure in said passage and the pressure in said second chamber urge said valve element to the closed position thereof and so that when the pressure in said passage inlet end in said at least a predetermined amount greater than the pressure in said second chamber and and also at least a predetermined amount greater than the pressure in said outlet end, the resultant forces on said exhaust valve element produced by the pressures in said passage and the pressure in said second chamber urge and exhaust valve element to the open position thereof.

7. The accelerator of claim 3 further comprising means for releasably retaining said exhaust valve element upon movement thereof to the open position thereof.

8. The accelerator of claim 3 further comprising interconnecting means maintaining said antiflood valve an said relief valve in the opposite respective position thereof.

9. In the accelerator of claim 8, said exhaust valve element being releasably retained in the open position thereof by said interconnecting means upon movement of said exhaust valve element to the open position thereof when said antiflood valve is in the closed position thereof.

10. The accelerator of claim 8 further comprising retaining means engageable with said interconnecting means for automatically releasably retaining said interconnecting means in a position wherein said antiflood valve is in the closed position thereof and said relief valve is in the open position thereof.

11. The accelerator of claim 7 further comprising retaining means engageable with said interconnecting means for automatically releasably retaining said interconnecting means in a position wherein said antiflood valve is in the closed position thereof and said relief valve is in the open position thereof.

12. In the accelerator of claim 10, said retaining means comprising a latch which is biased to a position of engagement with said interconnecting means to retain said interconnecting means when it is in said position thereof wherein said antiflood valve is in the closed position thereof, and means for releasing said tongue from engagement with said interconnecting means.

13. In the accelerator of claim 12, said latch further characterized as a resilient tongue.

14. In the accelerator of claim 12, said releasing means further characterized as being manually operable from the exterior of said housing.

15. In the accelerator of claim 12, said releasing means further characterized as a threaded member threadedly received in an aperture in said second chamber and engageable with said tongue to move it from engagement with said interconnecting means upon threaded rotation of said threaded member.

16. In the accelerator of claim 1, said antiflood valve further characterized as an elongated pin sealingly receivable in said antiflood aperture to define the closed position of said antiflood valve and a spring element biasing said pin to a position wherein it is withdrawn from said antiflood aperture to define the open position of said antiflood valve.

17. In the accelerator of claim 4, said relief valve further characterized as an elongated pin sealingly receivable in said relief port to define the closed position of said relief valve but movable to a withdrawn position from said relief port to define the open position of said relief valve.

18. In the accelerator of claim 8, said interconnecting means comprising a mechanical linkage which extends between said antiflood valve and said relief valve for maintaining them in the opposite respective positions thereof.

19. In the accelerator of claim 18, said mechanical linkage further characterized as a lever which extends between said antiflood valve and said relief valve, said lever being pivotable about a fulcrum point which is between said antiflood valve and said relief valve for maintaining said antiflood valve and said relief valve in the opposite respective positions thereof.

* * * * *